US010535925B2

(12) United States Patent
Kerselaers et al.

(10) Patent No.: US 10,535,925 B2
(45) Date of Patent: Jan. 14, 2020

(54) WIRELESS DEVICE ANTENNA

(71) Applicant: NXP B.V., Eindhoven (NL)

(72) Inventors: Anthony Kerselaers, Herselt (BE); Liesbeth Gommé, Anderlecht (BE)

(73) Assignee: NXP B.V., Eindhoven (NL)

( * ) Notice: Subject to any disclaimer, the term of this patent is extended or adjusted under 35 U.S.C. 154(b) by 81 days.

(21) Appl. No.: 15/699,065

(22) Filed: Sep. 8, 2017

(65) Prior Publication Data

US 2019/0081397 A1 Mar. 14, 2019

(51) Int. Cl.

| | |
|---|---|
| ***H01Q 5/30*** | (2015.01) |
| ***H01Q 1/27*** | (2006.01) |
| ***H01Q 1/44*** | (2006.01) |
| ***H01Q 5/307*** | (2015.01) |
| ***H01Q 5/20*** | (2015.01) |
| ***H01Q 1/38*** | (2006.01) |
| ***H01Q 7/00*** | (2006.01) |

(52) U.S. Cl.

CPC ..... *H01Q 5/307* (2015.01); *H01Q 1/273* (2013.01); *H01Q 1/38* (2013.01); *H01Q 1/44* (2013.01); *H01Q 5/20* (2015.01); *H01Q 7/00* (2013.01)

(58) Field of Classification Search

CPC ..... H01Q 1/24; H01Q 1/241; H01Q 1/242; H01Q 1/243; H01Q 1/273; H01Q 1/38; H01Q 1/44; H01Q 5/20; H01Q 5/307; H01Q 5/342; H01Q 5/357; H01Q 5/364

See application file for complete search history.

(56) References Cited

U.S. PATENT DOCUMENTS

| | | | | |
|---|---|---|---|---|
| 7,859,469 | B1 | 12/2010 | Rosener et al. | |
| 9,331,384 | B2 * | 5/2016 | Jenwatanavet | H01Q 1/46 |
| 9,402,120 | B2 | 7/2016 | Linden et al. | |
| 2016/0205461 | A1 | 7/2016 | Fernandez-Medina et al. | |
| 2016/0254588 | A1 * | 9/2016 | Kim | H01Q 1/24 343/702 |

FOREIGN PATENT DOCUMENTS

| | | | |
|---|---|---|---|
| DK | 201470487 | A1 | 8/2014 |
| EP | 2 119 197 | B1 | 7/2012 |
| EP | 3110174 | A1 | 6/2016 |

* cited by examiner

*Primary Examiner* — Daniel Munoz
*Assistant Examiner* — Patrick R Holecek

(57) ABSTRACT

Example antenna configured to be coupled to a first conductive structure having a first portion and a second portion, the antenna including: a second conductive structure having a first portion and a second portion; wherein the first portion of the second conductive structure is configured to be coupled to the first portion of the first conductive structure; a first feed point configured to be coupled to the second portion of the first conductive structure; wherein the first portion of the first conductive structure is configured to carry the RF signal current with a first current density; wherein the first portion of the second conductive structure is configured to carry the RF signal current with a second current density; wherein the first and second current densities are different.

16 Claims, 7 Drawing Sheets

WIRELESS DEVICE ANTENNA

The present specification relates to systems, methods, apparatuses, devices, articles of manufacture and instructions for wireless communication.

SUMMARY

According to an example embodiment, an antenna configured to be coupled to a first conductive structure having a first portion and a second portion, the antenna comprising: a second conductive structure having a first portion and a second portion; wherein the first portion of the second conductive structure is configured to be coupled to the first portion of the first conductive structure; a first feed point configured to be coupled to the second portion of the first conductive structure; wherein the second portion of the second conductive structure is coupled to a second feed point; wherein the first and second feed points are configured to be responsive to a radio frequency (RF) signal current; wherein the first portion of the second conductive structure is configured to be substantially in parallel with and have a different area than the first portion of the first conductive structure; wherein the first portion of the first conductive structure is configured to carry the RF signal current with a first current density; wherein the first portion of the second conductive structure is configured to carry the RF signal current with a second current density; and wherein the first and second current densities are different.

In another example embodiment, the second portion of the second conductive structure is configured to be substantially in parallel with and have a different area than the second portion of the first conductive structure; the second portion of the first conductive structure is configured to carry the RF signal current with a third current density; the second portion of the second conductive structure is configured to carry the RF signal current with a fourth current density; and the third and fourth current densities are different In another example embodiment, the first and second spatial orientations are responsive to an RF far-field transverse wave; and the third and fourth spatial orientations are responsive to an RF surface wave.

In another example embodiment, the first portion of the second conductive structure is configured to be in galvanic contact with the first portion of the first conductive structure; the first feed point is configured to be in galvanic contact with the second portion of the first conductive structure; and the second portion of the second conductive structure is in galvanic contact with the second feed point.

In another example embodiment, the first conductive structure includes a power source having internal power circuitry.

In another example embodiment, the power source includes at least one of: a voltage source, a current source, or a wireless resonant coil.

In another example embodiment, the first conductive structure is a battery, the first portion of the first conductive structure is an anode, and the second portion of the first conductive structure is a cathode.

In another example embodiment, the first portion of the second conductive structure is configured to be galvanically coupled to the anode; and the second portion of the second conductive structure is galvanically coupled to an electronic circuit.

In another example embodiment, further comprising a ground-plane configured to be coupled between the first feed point and the second portion of the first conductive structure; wherein the ground-plane is configured to be substantially either parallel or perpendicular to the first portion of the first conductive structure.

In another example embodiment, the ground-plane, first and second feed points and second conductive structure are fixedly attached to a printed circuit board.

In another example embodiment, further comprising the first conductive structure; wherein the first conductive structure is a battery holding structure.

In another example embodiment, the first RF signal current spatial orientation has a first current density; the second RF signal current spatial orientation has a second current density; and the first and second current densities are different.

In another example embodiment, the first and second portions of the second conductive structure added to the coupling of the second feed point to the second portion of the second conductive structure is ¼ wavelength of a frequency of the RF signal.

In another example embodiment, a total electrical length of the first conductive structure, the second conductive structure, and the couplings to the first and second feed points is at least one tenth wavelength of a frequency of the RF signal.

In another example embodiment, a geometrical shape of the first portion of the second conductive structure is at least one of: a circular shape, a rectangular shape, or a spiral shape.

In another example embodiment, the antenna is embedded in at least one of: a dongle, a mobile device, a smartphone, a game console, a wireless device, a wearable device, a hearing aid, an earbud, a smart watch, an audio device, or a wireless road traffic device.

The above discussion is not intended to represent every example embodiment or every implementation within the scope of the current or future Claim sets. The Figures and Detailed Description that follow also exemplify various example embodiments.

Various example embodiments may be more completely understood in consideration of the following Detailed Description in connection with the accompanying Drawings, in which:

Figure 1A:
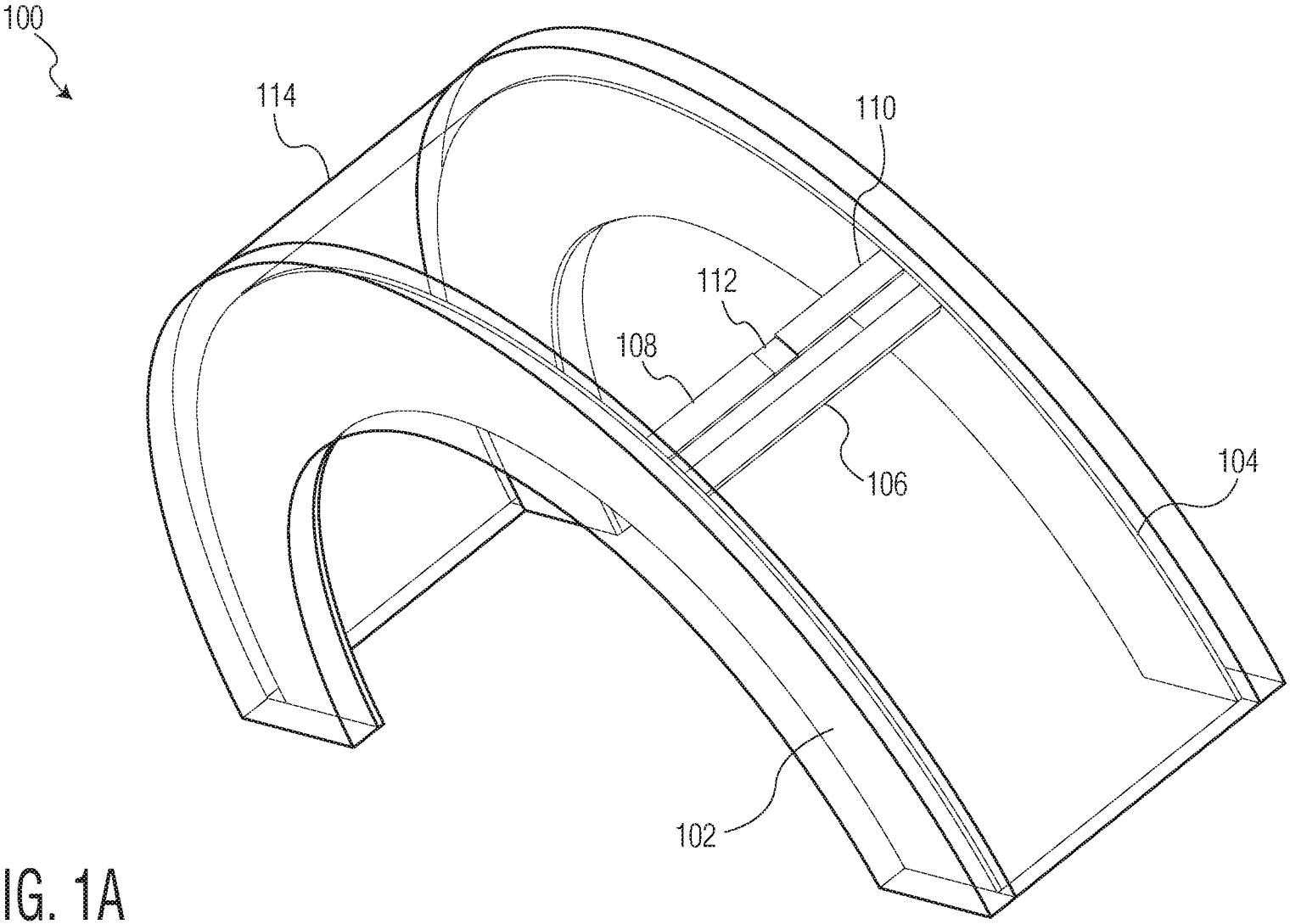
FIG. 1A is an example first wireless device antenna structure.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

DETAILED DESCRIPTION

Various wireless device form-factors, mobile or fixed, are getting smaller. For example, earbuds, hearing aids, wearable devices, and smartphones are shrinking in size and increasing in functional capability, such as communications between two sets of earbud pairs on different users. Upcoming V2X (Vehicle-to-Everything) and IoT (Internet of Things) devices are also planned for dramatic increase.

In some examples, wireless devices include earbuds or hearing aids. They can communicate by means of analogue or digital modulation techniques and can contain data or audio information. The audio can be high quality audio, like CD quality or can be of lower quality speech. In the former case a higher bandwidth of the communication channel is required.

Other wireless devices may include wearable devices, which in one example can be used in a car environment and designed to communicate various information (e.g. road traffic information) with other drivers, pedestrians, cars, bicycles, etc. according to various Car2X wireless communications standards.

Such wireless devices preferably are able to communicate using different wireless standards (e.g. Bluetooth, WIFI or Cellular), but also using different propagation modes. For example, a first propagation mode (i.e. off-body mode) can use transversal waves that propagate over long distances, and a second propagation mode (i.e. on-body mode) can use surface waves [(i.e. creeping wave, ground wave, traveling wave, etc.). Surface waves are part of a class of electromagnetic waves that diffract around surfaces, such as a sphere, a building, a person, and so on.

In some example embodiments, both the on-body and off-body modes use RF frequencies to communicate (e.g. ISM band communication may use a 2.4 GHz carrier frequency, and Car2X which uses a 5.9 GHz carrier frequency for road traffic and vehicle communication).

Adding such "on-body" and "off-body" communication to a wearable device is challenging due to the small form-factor of most wearable devices. For example an earbud can be as small as 15 mm, while the wavelength of a Bluetooth 2.5 GHz radio signal is 122 mm. Resonant antennas of a half wavelength (½λ) electrical length (i.e. 61 mm in this example) will work with good efficiency. However such a 61 mm antenna may not reasonably fit into an earbud with a length of 15 mm. The antenna's electrical length can also be influenced by dielectric materials or nearby objects or folding of the conductive structure.

FIG. 1A is an example first wireless device antenna structure 100. The antenna 100 consists of a transmission line with two conducting surfaces 102, 104, lines 106, 108, 110, and a gap 112. Either portion of the gap 112 becomes the feed points for the antenna 100 and are connected to another RF circuit (not shown). A non-conductive material 114 encases the antenna 100. In one example, the first antenna structure 100 is integrated into a hearing aid.

The conducting surfaces 102, 104 of the transmission line are opposite to each other and a distance between them can vary along their length. The length of conducting surfaces 102, 104 of the transmission line, together with the position and length of line 106 determines a resonance frequency of the antenna 100.

Lines 106, 108, 110 are the major radiating elements in this antenna 100. This is because the currents in conducting surfaces 102, 104 are opposite to each other, cancelling out their radiation. Currents in lines 106, 108, 110 are mainly going in the same direction and thereby generate far field radiation.

Conducting surfaces 102, 104 do affect the electrical length of the antenna 100 and enable the antenna 100 to resonate at half a wavelength of the carrier frequency (61 mm at 2.5 GHz). As mentioned above, such a 61 mm electrical length in this design can be a serious burden in small hearing aids or earbuds.

Figure 1B:
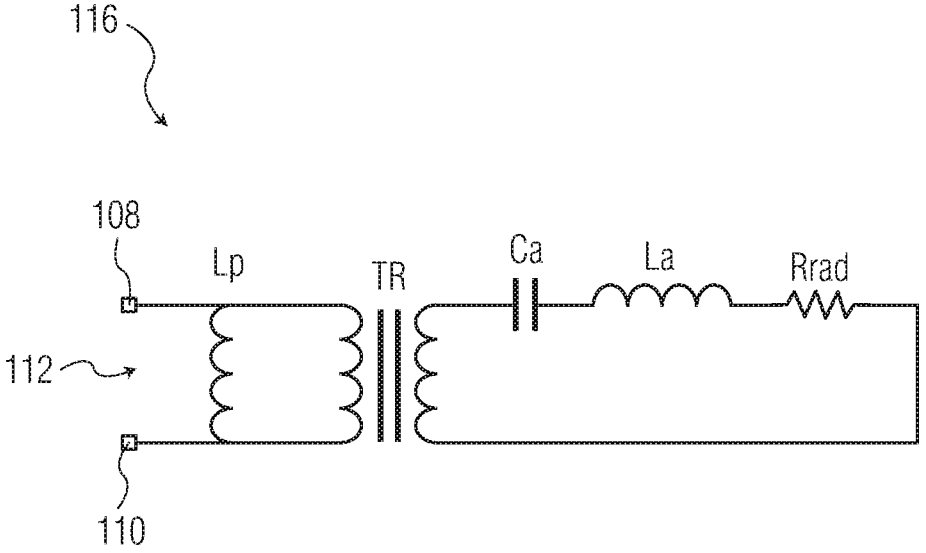
FIG. 1B is a first example circuit corresponding to the first wireless device antenna structure.

FIG. 1B is a first example circuit 116 corresponding to the first wireless device antenna structure 100. Resistance (Rrad) in one example is much lower than 50 ohms and is transformed by an ideal transformer (TR). In resonance reactance XCa=reactance XLa.

Figure 1C:
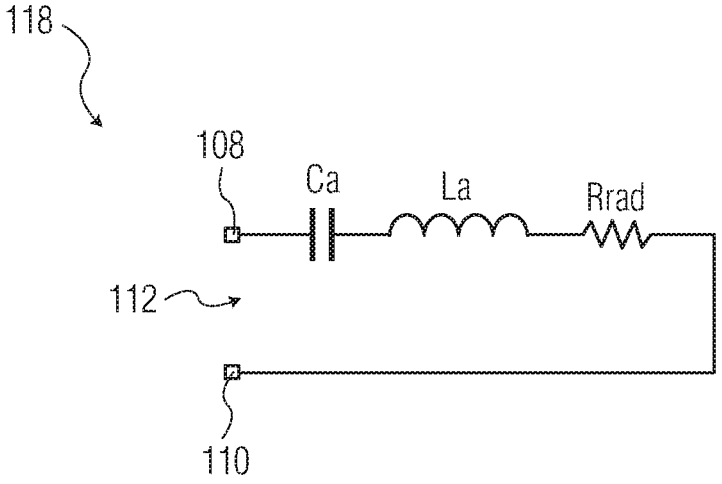
FIG. 1C is a second example circuit corresponding to the first wireless device antenna structure.

FIG. 1C is a second example circuit 118 corresponding to the first wireless device antenna structure 200. In this example, Rrad is set to 50 ohms or lower and then matched externally. As before, in resonance reactance XCa=reactance XLa.

Figure 2:
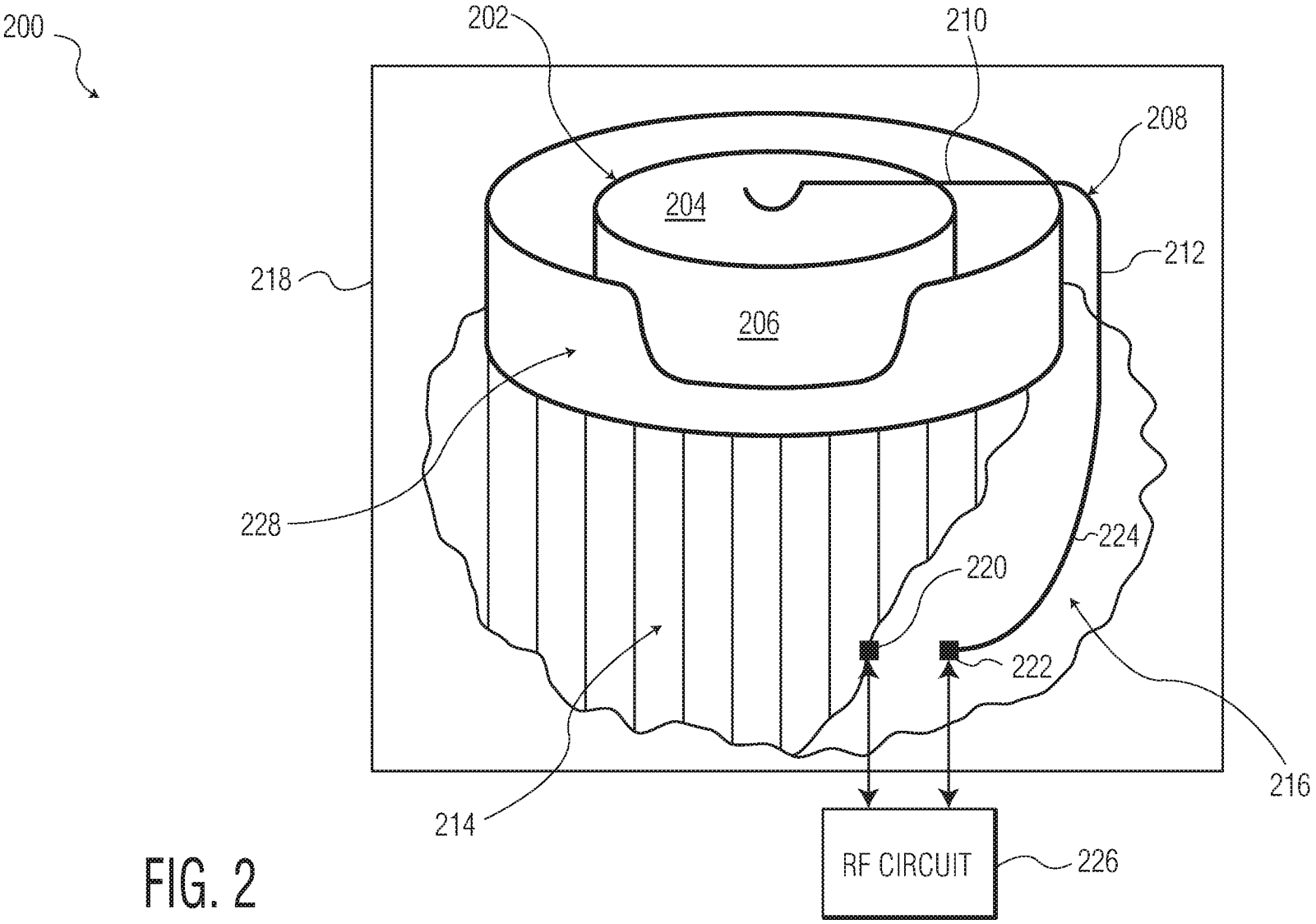
FIG. 2 is a perspective view of an example second wireless device antenna structure.

FIG. 2 is a perspective view of an example second wireless device antenna structure 200. The second wireless device antenna structure 200 is a loop antenna including a first conductive structure 202 (e.g. battery), a second conductive structure 208 (e.g. strip, clip, etc.), a ground-plane 214, a dielectric area 216, a printed circuit board (PCB) 218, a first feed point 220, a second feed point 222, a conductor 224 (e.g. wire trace on PCB), an RF circuit 226 (e.g. radio integrated circuit (RF-IC)), and a holding structure 228 (e.g. battery holder). This loop antenna 200 can be designed for series mode resonance as will be discussed.

The first conductive structure 202 (e.g. battery) includes a first portion 204 (e.g. top of the battery) substantially parallel to the ground-plane 214, a second portion 206 (e.g. side of the battery) substantially perpendicular to the ground-plane 214. A geometrical shape of the first portion 210 of the second conductive structure 208 can be: circular, rectangular, spiral, or any other shape.

The second conductive structure 208 (e.g. strip, clip, etc.) includes a first portion 210 (e.g. over top of battery) and a second portion 212 (e.g. next to side of battery).

The antenna 200 is configured to be coupled to the first conductive structure 202 (e.g. battery) however, the first conductive structure 202 in some embodiments is a removeable battery or power source. The first portion 210 of the second conductive structure 208 is configured to be coupled to the first portion 204 of the first conductive structure 202. The first feed point 220 is configured to be coupled to the second portion 206 of the first conductive structure 202. The second portion 212 of the second conductive structure 208 is coupled to the second feed point 222. In some example embodiments conductor 224 (e.g. wire trace on PCB) connects the second portion 212 of the second conductive structure 208 to the second feed point 222.

The first and second feed points 220, 222 are configured to be responsive to (e.g. transmit or receive) an RF signal current to and/or from the RF circuit 226.

The first portion 210 of the second conductive structure 208 is configured to be substantially in parallel with and have a different area than the first portion 204 of the first conductive structure 202. Due to this difference in area the first portion 204 of the first conductive structure 202 will carry the RF signal current with a first current density, and the first portion 210 of the second conductive structure 208 will carry the RF signal current with a second current density. These first and second current densities are different. In some example embodiments, these differences between the first and second current densities enable the antenna 200 to be responsive to a far-field RF transverse wave with a polarization in the direction of the first portion 210 (discussed further below).

The second portion 212 of the second conductive structure 208 is configured to be substantially in parallel with and have a different area than the second portion 206 of the first conductive structure 202. Thus, the second portion 206 of the first conductive structure 202 carries the RF signal current with a third current density, and the second portion 212 of the second conductive structure 208 carries the RF signal current with a fourth current density. These third and fourth current densities are different. In some example embodiments, these differences between the third and fourth current densities enable the antenna 200 to be responsive to an RF surface wave (also discussed further below).

The RF currents are spread out across the various portion 204, 206, 210, 212 surfaces, which have different spatial orientations. Since these RF currents go in different directions and the portions 204, 206, 210, 212 have different areas, far field radiation in multiple polarizations suitable for different communication modes is enabled.

In some example embodiments, the first portion 210 of the second conductive structure 208 is configured to be in galvanic contact with the first portion 204 of the first conductive structure 202; the first feed point 220 is configured to be in galvanic contact with the second portion 206 of the first conductive structure 202; and the second portion 212 of the second conductive structure 208 is in galvanic contact with the second feed point 222.

In certain example embodiments, the first conductive structure 202 includes a power source having internal power circuitry. The power source may include either: a voltage source, a current source, or a wireless charging resonant coil.

In other example embodiments, the first conductive structure 202 is a battery, the first portion 204 of the first conductive structure 202 is an anode, and the second portion 206 of the first conductive structure 202 is a cathode. In example embodiments with galvanic coupling, the first portion 210 of the second conductive structure 208 is galvanically coupled to the anode; and the second portion 212 of the second conductive structure 208 is galvanically coupled to an electronic circuit (not shown) that provides supporting circuitry for the antenna 200 and/or other electronic functions.

While not all example embodiments require the ground-plane 214, those that do can couple the ground-plane 214 between the first feed point 220 and the second portion 206 of first conductive structure 202 (e.g. battery). While as introduced above, the ground-plane 214 can be substantially parallel to the first portion 204 of the first conductive structure 202, in an alternate embodiment the ground-plane 214 can be substantially perpendicular to the first portion 204 of the first conductive structure 202. In some examples, the ground-plane 214 made from copper, perhaps a 35 micrometer thin copper layer.

In some example embodiments, the ground-plane 214, first and second feed points and second conductive structure 208 are fixedly attached to the printed circuit board 218. The printed circuit board 218 can be a flexible material or any other substrate that can contain electronic components and conductors. A second printed circuit board (PCB) can be positioned, perhaps on top of the first conductive structure 202 (e.g. battery), to add additional circuitry. These printed circuit boards can include various other electronic components such as communication IC's. See FIG. 4 for additional circuits that can be included.

Some example embodiments, may further include a battery holding structure 228.

The antenna 200 may be further tuned for various resonant frequencies by adjusting a ratio of an area of the ground-plane 214 to the dielectric area 216 on the PCB 218. A length of conductor 224 near or printed on the PCB 218 within the dielectric area 216 can also be adjusted to tune the antenna 200. The dielectric area 216 also isolates the first and second feed points 220, 222.

In some example embodiments, a total electrical length of the first conductive structure 202, the second conductive structure 208, and the couplings to the first and second feed points 220, 222 is at least one tenth (i.e. 0.1) wavelength of a frequency of the RF signal to ensure a minimal wireless communications performance. Additional tuning of the electrical length can be done using matching.

In various example embodiments, the antenna 200 is embedded in perhaps: a dongle, a mobile device, a smartphone, a game console, a wireless device, a wearable device, a hearing aid, an earbud, a smart watch, an audio device, or a wireless road traffic device.

During operation of some examples of the antenna 200, particularly those whose first conductive structure 202 is a battery, at DC (i.e. 0 Hz) the antenna structure 200 is shorted. Then at a first resonance frequency (F1) the antenna structure 200 has a high impedance between the feed points 220, 222 and may be difficult to impedance match to a further electronic circuit. Further at a second resonance frequency (F2) the antenna structure 200 has a low impedance between the feed points 220, 222 and can easily be impedance matched to a further electronic circuit.

Figure 3:
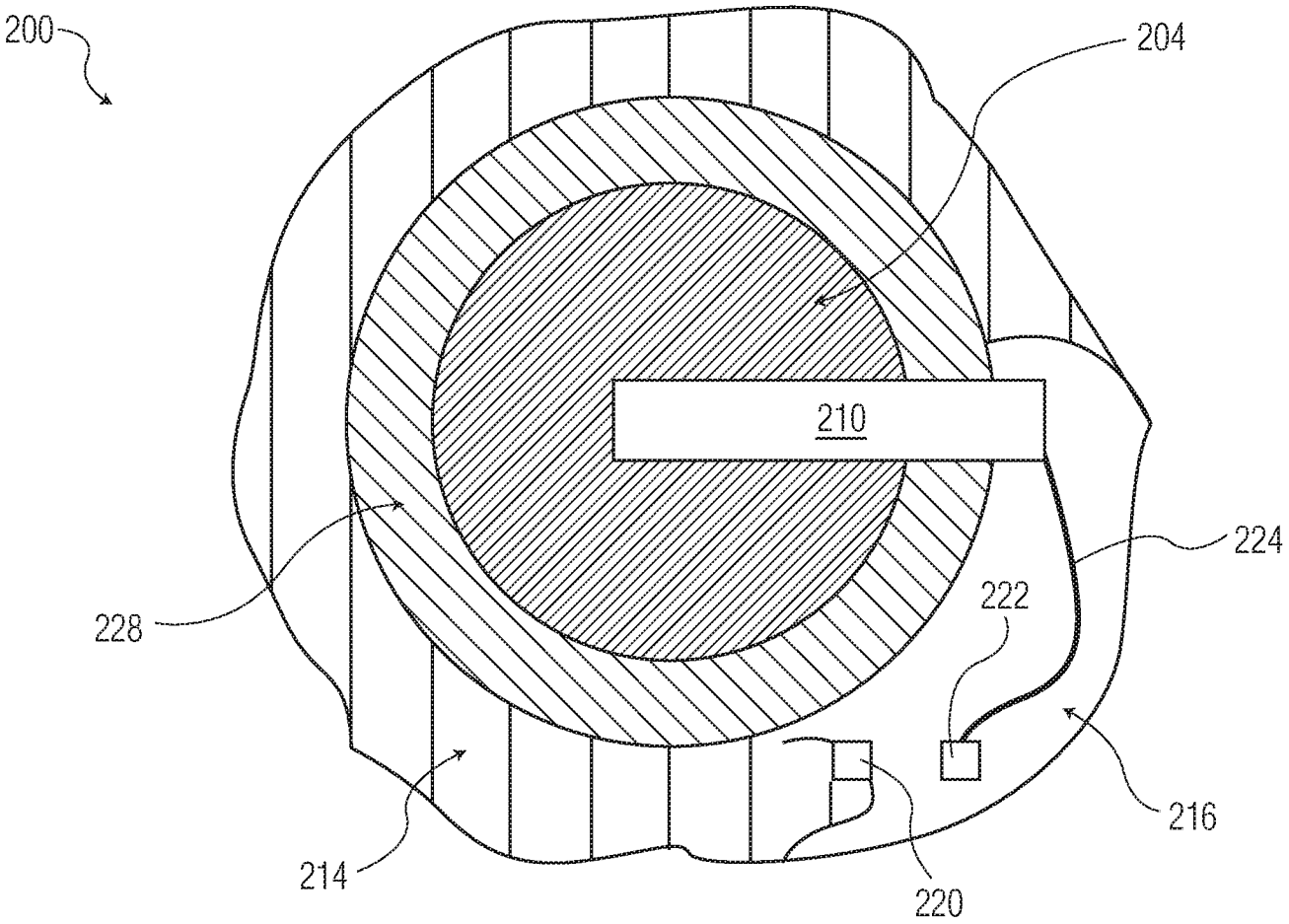
FIG. 3 is a top view of the example second wireless device antenna structure.

FIG. 3 is a top view of the example second wireless device antenna structure 200.

Figure 4:
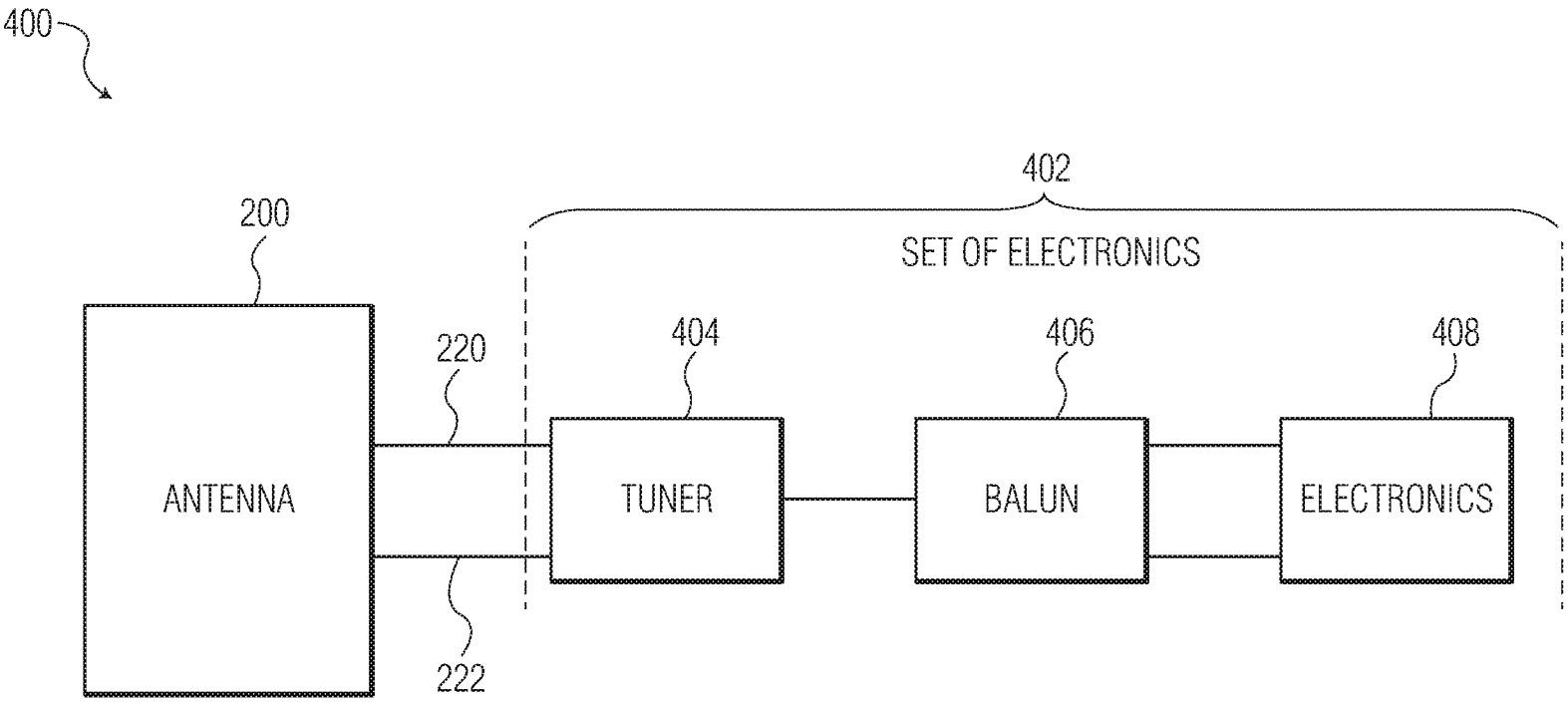
FIG. 4 is an example circuit coupled to the example second wireless device antenna structure.

FIG. 4 is an example circuit 400 coupled to the example second wireless device antenna structure 200. The antenna 200 feed points 220, 222 are coupled to a set of electronics 402. The set of electronics 402 include a tuning unit 404, a balun 406, and electronics 408 (e.g. radio and other wireless device functional circuits).

The tuning unit 404 impedance matches the antenna 200 to an impedance of the balun 406. At the RF antenna 200 operational frequencies, the balun 406 matches a balanced interface from the electronics 408 with an unbalanced interface from the tuning unit 404. Depending on the electronics 408, the balun 406 may or may not be optional.

Impedance matching maximizes power transfer between the electronics 408 and the antenna 200 in both transmit and receive modes.

Figure 5:
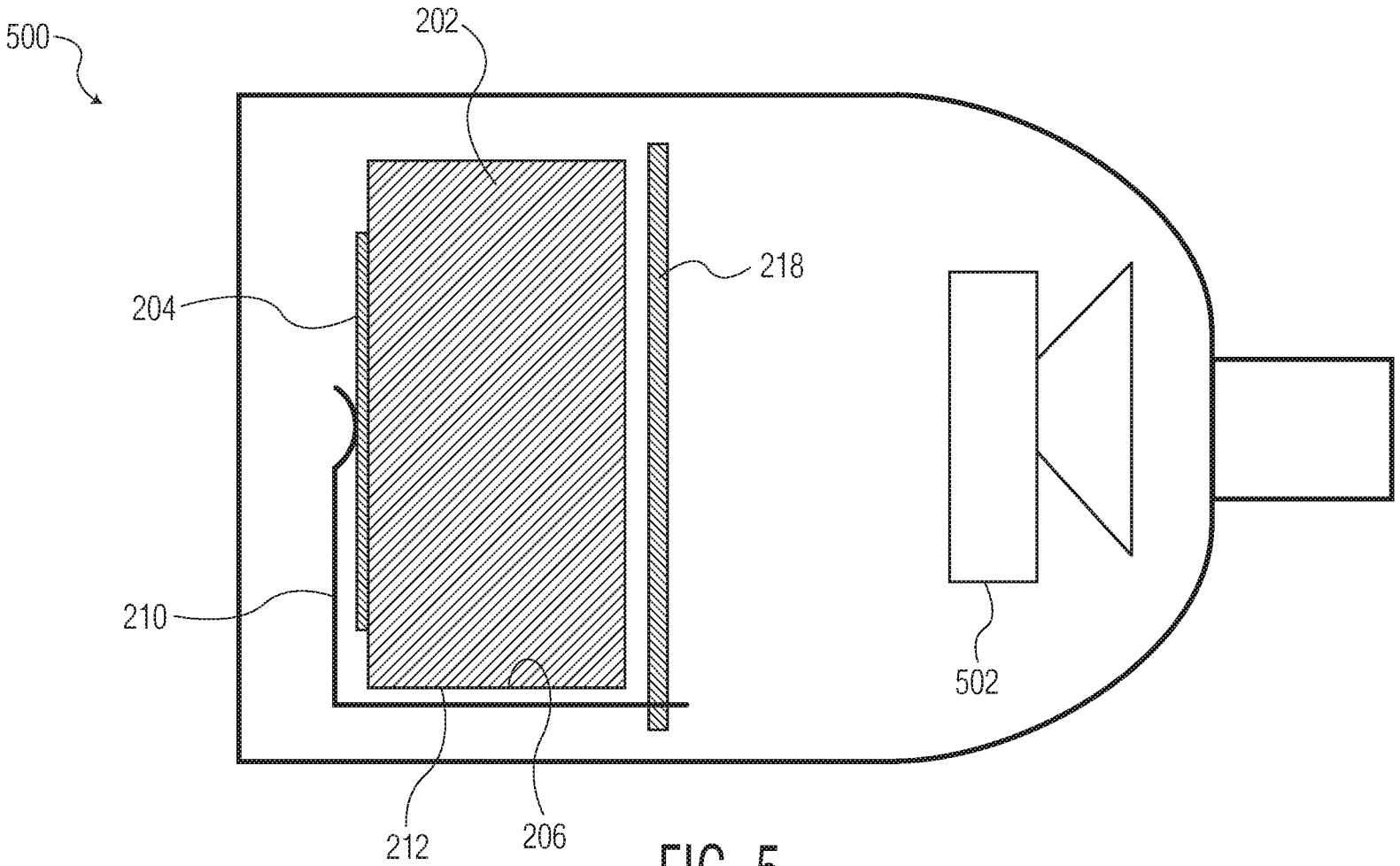
FIG. 5 is a side view of an example first earbud including the example second wireless device antenna structure.

FIG. 5 is a side view of an example first earbud 500 including the example second wireless device antenna structure 200. In this example 500 the earbud includes a loudspeaker 502 to reproduce audio signals. Radio and other electronics (not shown) are also included for earbud 500 functionality.

As shown in FIG. 5, the first portion 210 of the second conductive structure 208 and the first portion 204 of the first conductive structure 202 are configured to be responsive to (e.g. radiate and/or receive) a transverse RF wave. In one example embodiment, the first portion 210 is a metal clip over top of a battery anode (i.e. the first portion 204), and when the earbud 500 is inserted into a person's ear, the two first portions 204 and 210 will be parallel to the person's skin and be responsive to transverse RF wave.

Also as shown in FIG. 5, the second portion 212 of the second conductive structure 208 and the second portion 206 of the first conductive structure 202 are configured to radiate a surface RF wave. In one example embodiment, the second portion 212 is a continuation of the metal clip passing over the side of the battery (i.e. the second portion 206), and when the earbud 500 is inserted into a person's ear, the two second portions 206 and 212 will be perpendicular (i.e. normal) to the person's skin and be responsive to surface RF signals.

In this example embodiment, the antenna structure 200 is indistinguishable from the normal battery 202 connections and takes no appreciable space inside the earbud 500. Similar indistinguishable installations are possible for other wireless devices.

Figure 6:
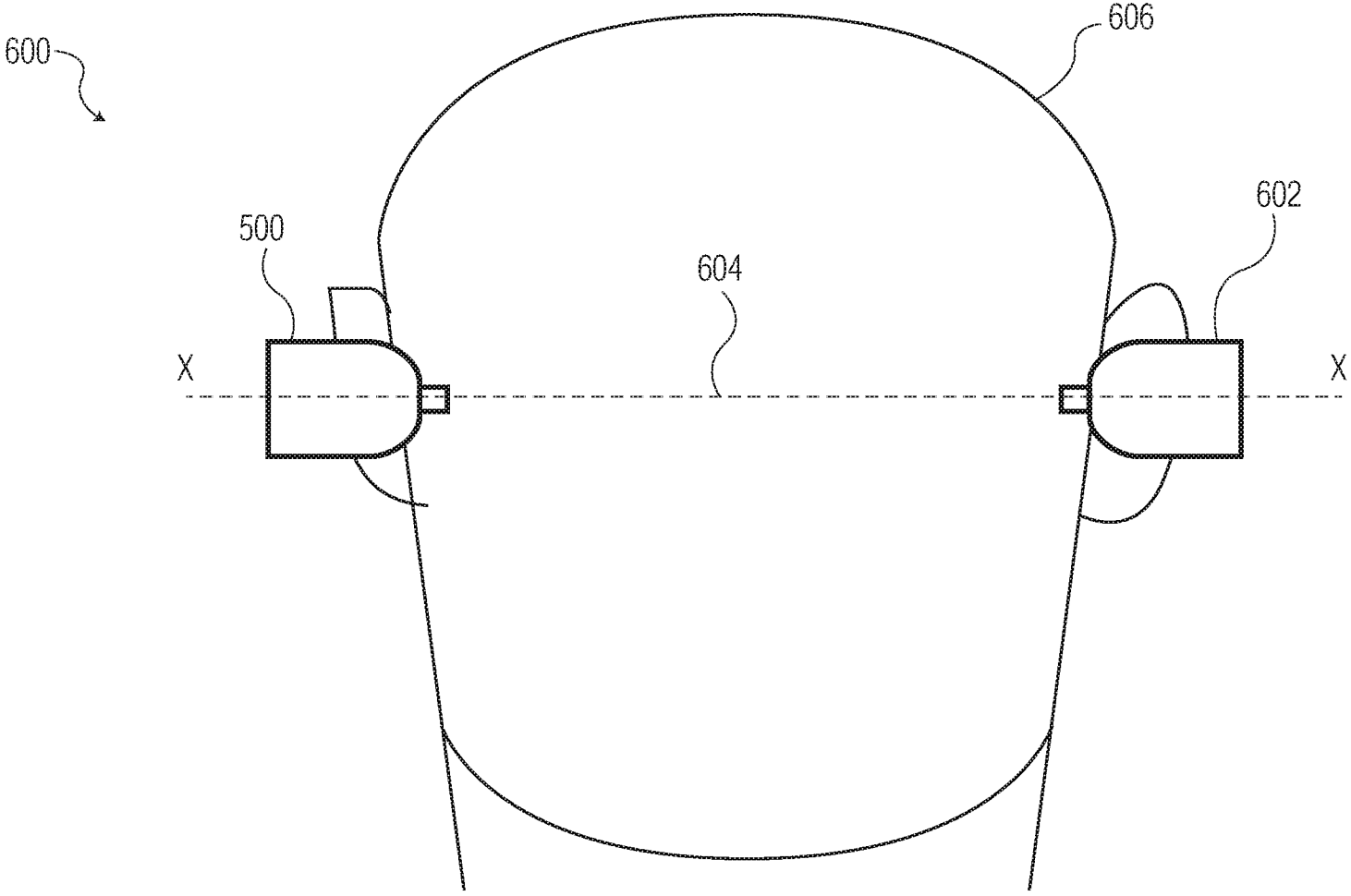
FIG. 6 is an example of how the first earbud and a second earbud including the example second wireless device antenna structure can be a wearable.

FIG. 6 is an example 600 of how the first earbud 500 and a second earbud 602 including the example second wireless device antenna structure 200 can function as a wearable on a user 606.

In one example, the antenna structure 200 in the earbuds 500, 602 is positioned according an imaginary line XX 604. This allows the antennal structure 200 to generate an electric field that is normal (i.e. perpendicular) to the skin of the user 606. Two modes of propagation, discussed earlier, are generated.

The first mode is an "on-body" mode where an electrical field vector is normal (i.e. perpendicular) to the user's 606 skin, for transmission and reception of the surface RF wave discussed in FIG. 5. With the "on-body" mode, "direct" communication from ear to ear is possible.

The second mode is the "off-body" mode where the electrical field vector is substantially parallel with the user's 606 skin, and where RF far-field transversal waves, discussed in FIG. 5, are generated and received. In the "off-body" mode, distant communication with another device (i.e. a smartphone, another earbud, a Car2X device, etc.) positioned away from the user 606 is possible.

It will be readily understood that the components of the embodiments as generally described herein and illustrated in the appended figures could be arranged and designed in a wide variety of different configurations. Thus, the detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

What is claimed is:

1. An antenna configured to be coupled to a first conductive structure having a first portion and a second portion, the antenna comprising:

a second conductive structure having a first portion and a second portion;

wherein the first portion of the second conductive structure is configured to be coupled to the first portion of the first conductive structure;

a first feed point configured to be coupled to the second portion of the first conductive structure;

wherein the second portion of the second conductive structure is coupled to a second feed point;

wherein the first and second feed points are configured to be responsive to a radio frequency (RF) signal current;

wherein the first portion of the second conductive structure is configured to be substantially in parallel with and have a different area than the first portion of the first conductive structure;

wherein the first portion of the first conductive structure is configured to carry the RF signal current with a first current density;

wherein the first portion of the second conductive structure is configured to carry the RF signal current with a second current density;

wherein the first and second current densities are different;

wherein the second portion of the second conductive structure is configured to be substantially in parallel with and have a different area than the second portion of the first conductive structure;

wherein the second portion of the first conductive structure is configured to carry the RF signal current with a third current density;

wherein the second portion of the second conductive structure is configured to carry the RF signal current with a fourth current density;

wherein the third and fourth current densities are different;

wherein the first portions of the first and second conductive structures are responsive to an RF far-field transverse wave; and wherein the second portions of the first and second conductive structures are responsive to an RF near-field surface wave.

2. The antenna of claim 1:

wherein the first portion of the second conductive structure is configured to be in galvanic contact with the first portion of the first conductive structure;

wherein the first feed point is configured to be in galvanic contact with the second portion of the first conductive structure; and wherein the second portion of the second conductive structure is in galvanic contact with the second feed point.

3. The antenna of claim 1:

wherein the first conductive structure includes a power source having internal power circuitry.

4. The antenna of claim 3:

wherein the power source includes at least one of: a voltage source, a current source, or a wireless resonant coil.

5. The antenna of claim 1:

wherein the first conductive structure is a battery, the first portion of the first conductive structure is an anode, and the second portion of the first conductive structure is a cathode.

6. The antenna of claim 5:

wherein the first portion of the second conductive structure is configured to be galvanically coupled to the anode; and wherein the second portion of the second conductive structure is galvanically coupled to an electronic circuit.

7. The antenna of claim 1:

further comprising a ground-plane configured to be coupled between the first feed point and the second portion of the first conductive structure;

wherein the ground-plane is configured to be substantially either parallel or perpendicular to the first portion of the first conductive structure.

8. The antenna of claim 7:

wherein the ground-plane, first and second feed points and second conductive structure are fixedly attached to a printed circuit board.

9. The antenna of claim 1:

further comprising the first conductive structure;

wherein the first conductive structure is a battery; and wherein the second conductive structure is a battery holding structure.

10. The antenna of claim 1:

wherein the first portion of the first conductive structure has a first current density;

wherein the first portion of the second conductive structure has a second current density; and wherein the first and second current densities are different.

11. The antenna of claim 1:

wherein the first and second portions of the first and second conductive structures electrically added have an electrical length substantially equal to ¼ wavelength of a frequency of the RF signal.

12. The antenna of claim 1:

wherein a total electrical length of the first conductive structure, the second conductive structure, and the couplings to the first and second feed points is at least one tenth wavelength of a frequency of the RF signal but less than or equal to ¼ wavelength of a frequency of the RF signal.

13. The antenna of claim 1:

wherein a geometrical shape of the first portion of the second conductive structure is at least one of: a circular shape, a rectangular shape, or a spiral shape.

14. The antenna of claim 1:

wherein the antenna is embedded in at least one of: a dongle, a mobile device, a smartphone, a game console, a wireless device, a wearable device, a hearing aid, an earbud, a smart watch, an audio device, or a wireless road traffic device.

15. A wearable device configured to be coupled to a first conductive structure having a first portion and a second portion, the wearable device comprising:

an antenna, including, a second conductive structure having a first portion and a second portion;

wherein the first portion of the second conductive structure is configured to be coupled to the first portion of the first conductive structure;

a first feed point configured to be coupled to the second portion of the first conductive structure;

wherein the second portion of the second conductive structure is coupled to a second feed point;

wherein the first and second feed points are configured to be responsive to a radio frequency (RF) signal current;

wherein the first portion of the second conductive structure is configured to be substantially in parallel with and have a different area than the first portion of the first conductive structure;

wherein the first portion of the first conductive structure is configured to carry the RF signal current with a first current density;

wherein the first portion of the second conductive structure is configured to carry the RF signal current with a second current density;

wherein the first and second current densities are different;

wherein the second portion of the second conductive structure is configured to be substantially in parallel with and have a different area than the second portion of the first conductive structure;

wherein the second portion of the first conductive structure is configured to carry the RF signal current with a third current density;

wherein the second portion of the second conductive structure is configured to carry the RF signal current with a fourth current density;

wherein the third and fourth current densities are different;

wherein the first portions of the first and second conductive structures are responsive to an RF far-field transverse wave; and wherein the second portions of the first and second conductive structures are responsive to an RF near-field surface wave.

16. A dongle, comprising:

an antenna, wherein the antenna includes, a first conductive structure having a first portion and a second portion;

a second conductive structure having a first portion and a second portion;

wherein the first portion of the second conductive structure is configured to be coupled to the first portion of the first conductive structure;

a first feed point configured to be coupled to the second portion of the first conductive structure;

wherein the second portion of the second conductive structure is coupled to a second feed point;

wherein the first and second feed points are configured to be responsive to a radio frequency (RF) signal current;

wherein the first portion of the second conductive structure is configured to be substantially in parallel with and have a different area than the first portion of the first conductive structure;

wherein the first portion of the first conductive structure is configured to carry the RF signal current with a first current density;

wherein the first portion of the second conductive structure is configured to carry the RF signal current with a second current density;

wherein the first and second current densities are different;

wherein the second portion of the second conductive structure is configured to be substantially in parallel with and have a different area than the second portion of the first conductive structure;

wherein the second portion of the first conductive structure is configured to carry the RF signal current with a third current density;

wherein the second portion of the second conductive structure is configured to carry the RF signal current with a fourth current density;

wherein the third and fourth current densities are different;

wherein the first portions of the first and second conductive structures are responsive to an RF far-field transverse wave; and wherein the second portions of the first and second conductive structures are responsive to an RF near-field surface wave.

* * * * *